US005301950A

United States Patent [19]

Patterson

[11] Patent Number: 5,301,950

[45] Date of Patent: Apr. 12, 1994

[54] GOLF PRACTICE TEE

[76] Inventor: Leonard G. Patterson, 5673 Sinclair Rd., Columbus, Ohio 43229

[21] Appl. No.: 102,778

[22] Filed: Aug. 6, 1993

[51] Int. Cl.[5] ..... A63B 69/36

[52] U.S. Cl. ..... 273/195 R; 273/33

[58] Field of Search ..... 273/195 R, 33, 203-211

[56] References Cited

U.S. PATENT DOCUMENTS 5,033,747 7/1991 Young ..... 273/195

5,156,403 12/1992 Mattino ..... 273/33 X

FOREIGN PATENT DOCUMENTS 4189374 7/1992 Japan ..... 273/211

*Primary Examiner*—Vincent Millin

*Assistant Examiner*—Raleigh W. Chiu

*Attorney, Agent, or Firm*—Francis T. Kremblas, Jr.

[57] ABSTRACT

An improved practice golf tee construction comprising an integrally formed base and a hollow stem portion vertically extending above said base and having an open top end forming a seat to receive a golf ball in a teed position. The side wall of the stem portion includes a pair of spaced openings or slots having outer edges extending downwardly from the open top of the stem and define a resilient strip portion of the side wall between the outer edges which is resiliently movable between a vertical position and an inwardly deflected position. This construction permits a golf ball to be manipulated into engagement with the resilient strip to deflect it inwardly and move the ball into engagement with the outer edges of the spaced slots which form an inclined ramp to guide the ball upwardly onto the seat of the stem portion whereupon the strip springs back to its normal vertical position to aid in stabilizing the ball in a teed position.

8 Claims, 4 Drawing Sheets

GOLF PRACTICE TEE

TECHNICAL FIELD

The present invention relates generally to practice golf tees of the type used with conventional golf driving range mats and particularly to an improved practice golf tee construction.

BACKGROUND ART

The popularity of the sport of golf has increased substantially over the last several years and accompanying this increase is an increased number of golf practice facilities. Such facilities include indoor and outdoor golf driving ranges and the use of golf practice mats providing a resilient surface and a golf practice tee extending upwardly through the practice mat.

The conventional golf practice tee comprises a one-piece, integrally molded unit of a resilient material having a disc-like base provided with a vertically extending hollow stem. The upper end of the hollow stem has an opening with beveled inner edges to form a seat to hold the golf ball in a teed position.

The tee is held in place by extending the stem through a suitable hole provided in the driving mat from the bottom surface of the mat so that the mat overlies the disc-like base to hold the stem in position raised above the upper surface of the mat.

The resilient material used for the tee is typically a synthetic rubber composition or a similar synthetic material which is resilient and yet strong enough to absorb abuse when repeatedly struck by a golf club.

While this form of practice tee has performed very well for many decades and is relatively inexpensive, the user is required to bend over and place a golf ball upon the tee for every practice shot struck. I am not aware of any golf practice tee which is also simple and inexpensive to manufacture and yet permits a user to conveniently tee a golf ball without bending over to tee the ball by hand and which further requires no change in the construction of the presently used type of practice golf mats.

BRIEF DISCLOSURE OF INVENTION

The present invention relates generally to practice golf tees and more particularly to an improved practice golf tee construction which permits one to tee a golf ball onto the tee without bending over and using one's hand to tee the ball.

The improved golf tee of the present invention relates to a modified construction of the conventional practice golf tee wherein the equivalent of a ramp is formed in the side walls of the vertically extending hollow stem portion. The ramp portion comprises a pair of downwardly and inwardly inclined edge portions spaced from one another about the periphery of the side walls and a cooperating resilient vertical extending strip portion of the side wall disposed between these edges. The strip may be resiliently deflected inwardly upon contact by the golf ball moved into engagement with the strip.

Upon inward deflection of the resilient strip, the inclined edges are exposed to receive the golf ball which may be manipulated using the head of a golf club to roll the ball up the ramp toward the top of the stem to be seated or teed thereon. When the golf ball reaches the top or seat of the stem, the resilient strip returns to its normal vertical position with its upper end forming part of the seat for the teed ball to prevent the ball from falling off the tee.

In a preferred embodiment, the ramp forming edges are made by a pair of downwardly and inwardly inclined slots or openings in the side wall interrupting the open top or seat to define the resilient, deflectable strip between the slots.

These slots can be shaped to provide different configurations to the resilient, deflectable strip relative to the size of the upper and lower ends thereof.

Other embodiments disclosed include a modified top opening or ball seat wherein the surrounding lip of the top opening may include variations in the edges or lip of the top opening forming the seat opposite to the resilient strip to aid in retaining the ball on the seat during the teeing process.

Preferably, the golf ball is teed by manipulation of the head of the golf club or the toe of one's shoe to roll the ball into contact with the resilient strip, thereby deflecting the strip inwardly to permit the ball to generally move upwardly in engagement with the inclined edges forming a ramp to the top of the stem to be seated thereon in a teed position. However, the tee is constructed to also permit one the option of teeing the ball in the conventional manner by bending over and using one hand to place the ball on the top of the stem if desired.

Therefore it is an object of the present invention to provide an improved golf practice tee of the type described which permits a user to tee a golf ball without bending over to lessen any strain upon the user's back and legs during the process of striking many practice shots.

It is another object of the present invention to provide an improved golf practice tee of the type described which is of simple, and inexpensive construction which is easily adapted to volume manufacture at low cost.

It is a further object to provide an improved golf practice tee of the type described which can be used with the conventional golf mats currently employed to make it convenient to replace the current conventional practice tee without changing the mat construction.

DETAILED DESCRIPTION

Figure 1:
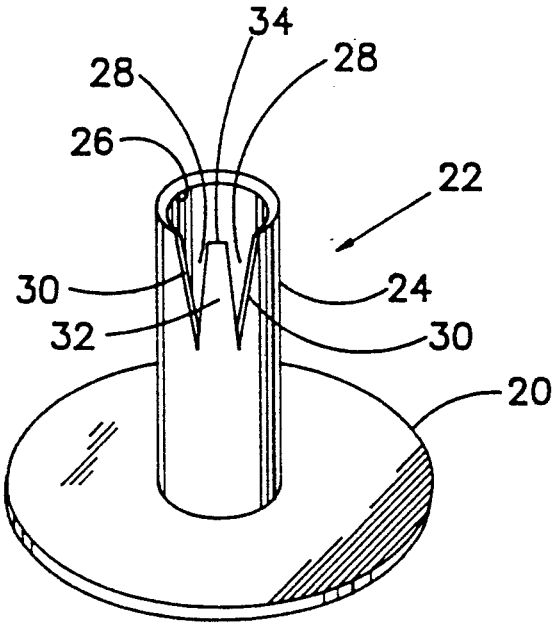
FIG. 1 is a perspective view of a preferred embodiment of a golf practice tee constructed in accordance with the present invention.

A golf practice tee constructed in accordance with the present invention is shown in FIG. 1 and comprises an integrally formed unit including a horizontally extending base 20 provided with a planar bottom surface for resting upon the planar floor surface of a driving area provided at a typical practice driving range.

A cylindrical, hollow stem portion, indicated generally at 22, integral with base 20 extends vertically upward from base 20 and includes side walls 24 which terminate at their upper end in a top opening forming a seat portion 26 having beveled inner edges forming a surrounding lip to more easily receive a golf ball on seat portion 26 in a teed position.

A pair of openings or slots 28 are formed in side walls 24 extending downwardly from seat portion 26 and interrupting the circumferential surface of walls 24 and the lip surrounding the top opening or seat 26.

The slots 28 also define the configuration of a resilient strip 3 integrally part of the side walls 24 disposed between slots 28. Preferably the base and stem are integrally molded from a resilient synthetic rubber or a similar material of the type used for the conventional practice golf tees currently used essentially exclusively with practice mats of the type employed at golf driving ranges.

Figure 9:
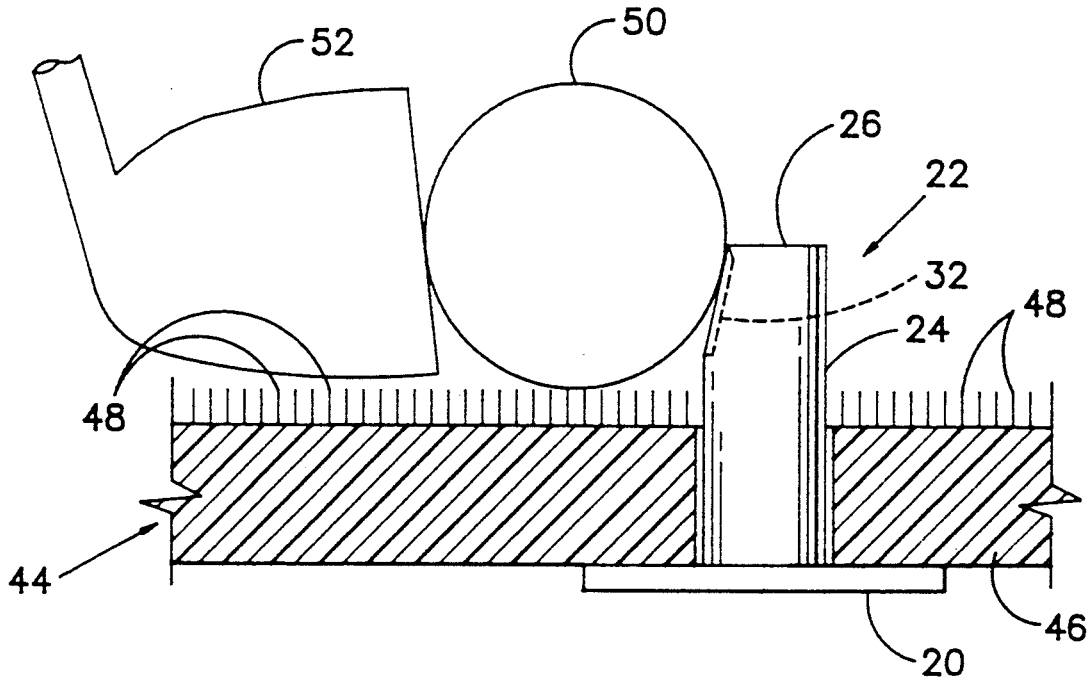

Strip 32 is normally in a vertical position in essentially the same radial plane of the remainder of side walls 24 of stem 22, but may be resiliently deflected inwardly such as shown in FIG. 9. Upon being deflected inwardly, strip 32 and outer edges 30 of slots 28 cooperate to form an inclined ramp to receive a golf ball for travel upwardly toward seat 26 as described in detail later herein.

The upper end 34 of strip 32 preferably is located in the same plane as the beveled edges of seat 26 or may be slightly lower than the unbroken edges of seat 26 as will be explained later in detail herein.

Now referring to FIGS. 2–6 wherein modified embodiments of the golf practice tee of the present invention are shown. Similar components in each of these Figures carry the same reference numeral as its counterpart in FIG. 1 followed by the letters a,b or c respectively.

Figure 2:
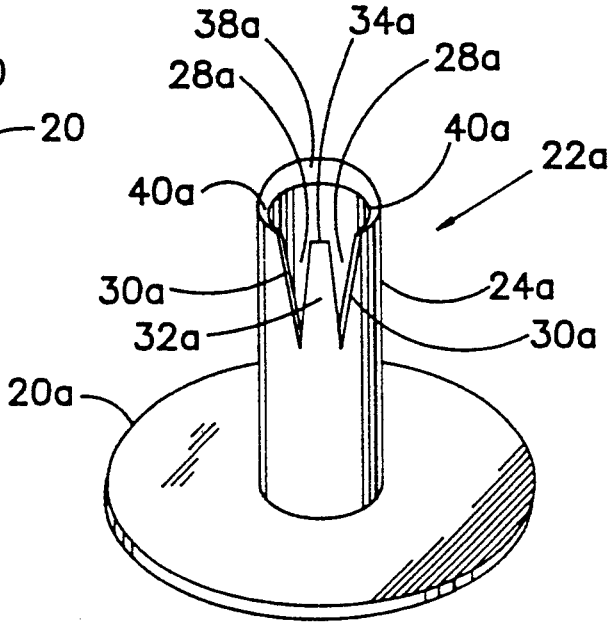
FIG. 2 is a perspective view of another preferred embodiment of a golf practice tee constructed in accordance with the present invention illustrating a modified seat portion for receiving the golf ball in a teed position.
Figure 5:
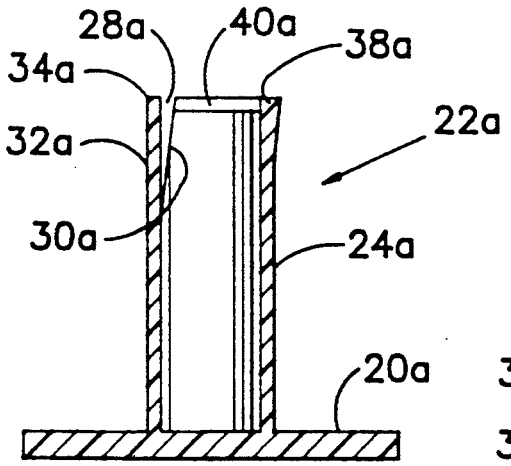
FIG. 5 is a side sectional view of the embodiment shown in FIG. 2, the section being taken along a vertical centerline of the practice tee.

As seen in FIGS. 2 and 5, the only difference between the embodiments in FIG. 1 and in FIGS. 2 and 5 relates to the surrounding beveled edges of the seat portions 26 as compared to 26-*a*. In FIG. 2, the upper edge portion of the seat 26-*a* directly opposite strip 32-*a* is increased in wall thickness at 38-*a* relative to the thickness at edge portions 40-*a*. The increased thickness at 38 provides a deeper beveled edge opposite strip 32-*a* which tends to provide a barrier or stop when mounting a golf ball up the ramp formed by edges 30-*a* and strip 32-*a* to aid in slowing the forward momentum of the golf ball being moved onto the seat and tends to prevent the ball from rolling over the edge of seat 26-*a* opposite strip 32-*a*.

Preferably, the additional thickness in the stem 24-*a* is provided at the outer circumference of stem 24-*a*, forming a bulge in the circumferential surface of the upper end thereof with the inner edge of the top opening being essentially identical in size to the embodiment shown in FIG. 1.

Figure 3:
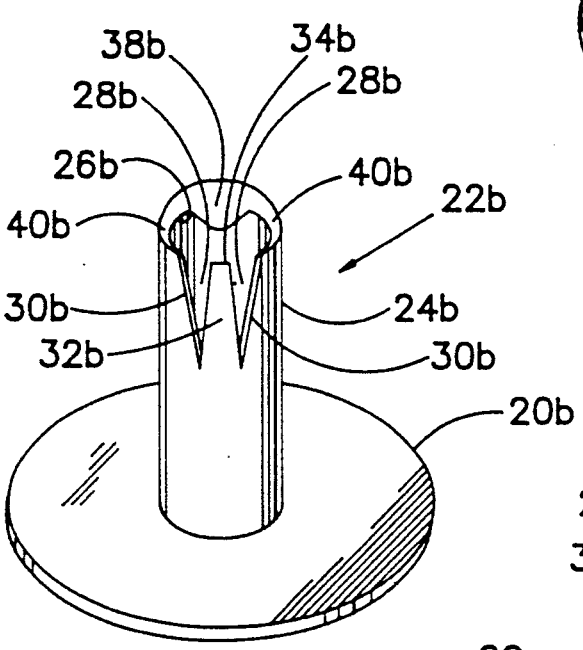
FIG. 3 is a perspective view of another preferred embodiment of a golf practice tee constructed in accordance with the present invention illustrating a different modification of the seat portion for receiving the golf ball in a teed position.
Figure 6:
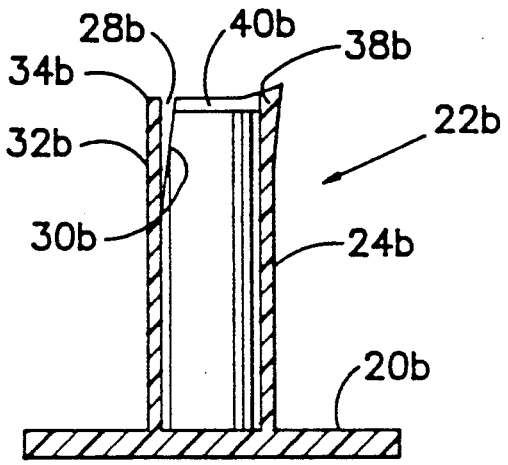
FIG. 6 is a side sectional view of the embodiment shown in FIG. 3, the section being taken along a vertical centerline of the practice tee.

A similar modification is shown in FIGS. 3 and 6 wherein the opposite side of seat portion 26-*b* relative to strip 32-*b* includes additional molded material to increase the thickness of the portion of the beveled edge at 40-*b* and also slightly increase its height compared to the surrounding beveled edge portions 42-*b*. This modification is directed to the same purpose as the modified embodiment shown in FIG. 2.

Figure 4:
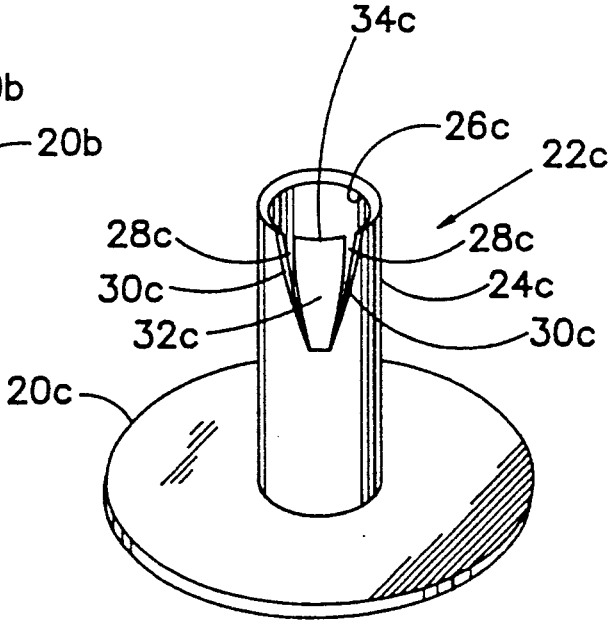
FIG. 4 is a perspective view of another preferred embodiment of a golf practice tee constructed in accordance with the present invention illustrating a modification of the shape of the resilient strip portion formed between the ramp edges in the stem portion of the tee compared to the embodiments shown in the preceding figures.

Now referring to FIG. 4, another modified embodiment of the present invention is shown wherein the configuration of resilient strip 32-*c* is modified compared to strip 32 shown in FIG. 1. Strip 32-*c* is merely configured to have a wider top portion 34-*c* and narrower base compared to strip 32, however, the downwardly inclined edges 30-*c* are very similar and cooperate with the inwardly deflected position of strip 32-*c* to form a ramp to receive a golf ball in essentially the same manner as the other embodiments described above.

Now referring to FIGS. 7–11, a diagrammatic illustration of a conventional golf practice mat 44 is shown with a practice tee constructed in accordance with the present invention. Mat 44 typically includes a heavier layer of a rubber-like synthetic material 46 covered by a layer comprising a plurality of closely spaced resilient synthetic fibers or the like, such as 48.

An opening or hole 49 is provided and generally is conformed to receive the stem 24 of the golf practice tee 22 such as shown in FIG. 1 which preferably has a diameter essentially identical or closely similar to the stem portion of a conventional practice tee described earlier herein.

Figure 7:
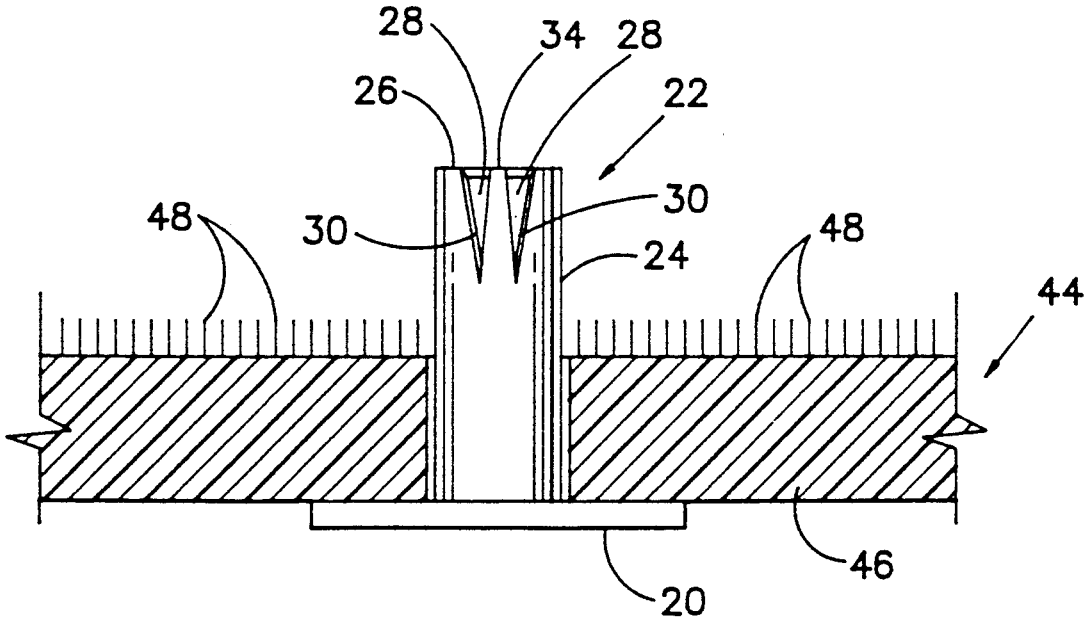
FIG. 7 is a front section view of a diagrammatically illustrated conventional golf mat with the golf practice tee constructed in accordance with the present invention disposed in its normal operative position to receive a golf ball.

As shown in FIG. 7, preferably, slots 28 may extend downwardly toward the top level of the fiber layer portion of matt 44 to provide sufficient height above the fiber layer portion to expose an adequate length of the stem 22 to appropriately tee a golf ball on seat 26 above the fiber layer. The length of stem 24 and the relative length of slots 28 may vary according to the desired height one wishes to raise the golf ball above the layer of fibers 48.

It should be noted that conventional golf practice mats in current use have upper layers which may have different textures and may lay flatter than those which have a plurality or generally upstanding, short blades or fibers, such as 48 which are similar to a conventional artificial grass surface.

Figure 8:
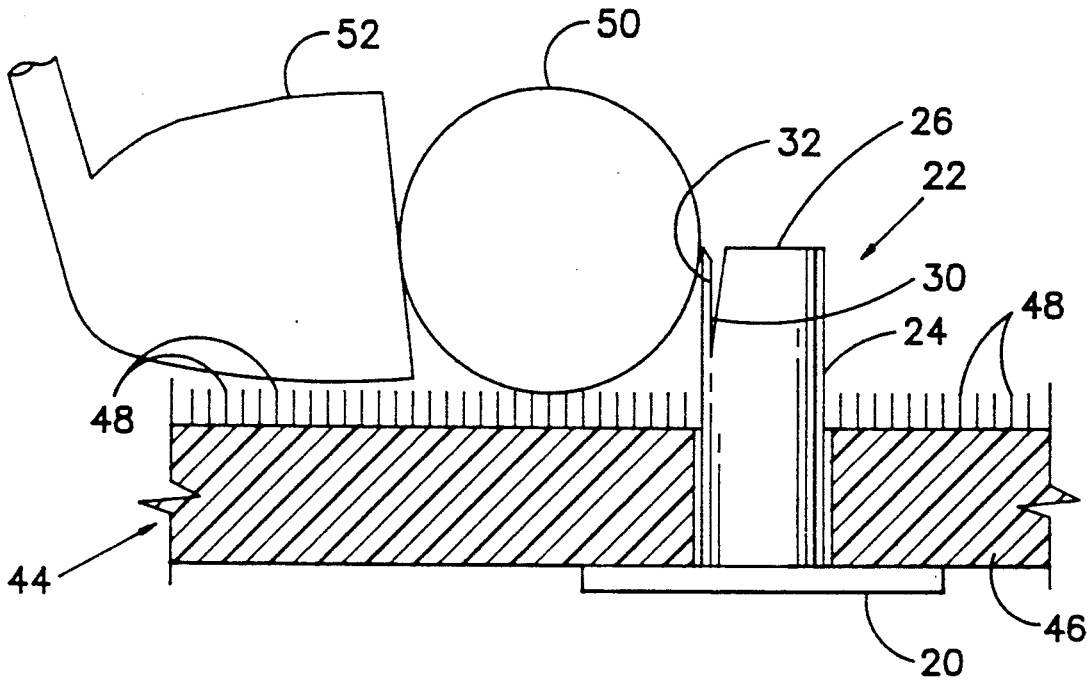
FIGS. 8, 9, 10 and 11 are side sectional views of the mat and tee shown in FIG. 5 illustrating the teeing process using the golf practice tee constructed in accordance with the present invention wherein the golf ball is moved in sequence into initial engagement with the resilient strip and then upwardly to the top of the stem in a final teed position.

To use the golf practice tee of the present invention, the user merely manipulates the ball 50, preferably with the head of the golf club 52, to a position shown in FIG. 8 aligned facing resilient strip 32. The golf ball 50 is then pushed with the club head into engagement with strip 32 to deflect it inwardly as seen in FIG. 9 and into engagement with the inclined edges 32 forming the outer dimensions of a ramp to roll the ball upwardly toward the seat portion 26.

Figure 11:
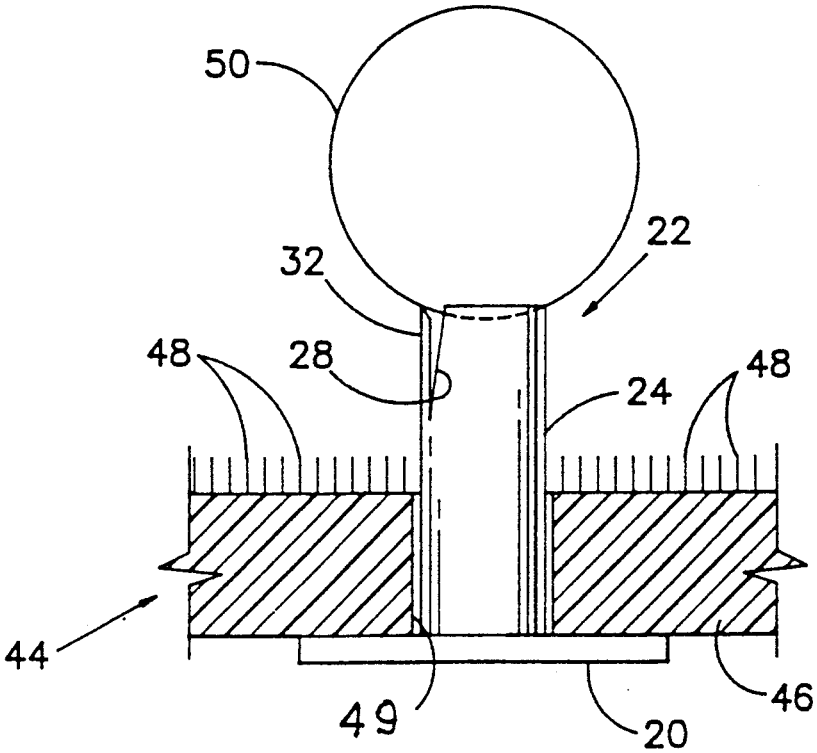

With surprisingly little practice, it is relatively easy to position golf ball 50 on seat portion 26 in a stable teed position such as shown in FIG. 11 as described above.

Figure 10:
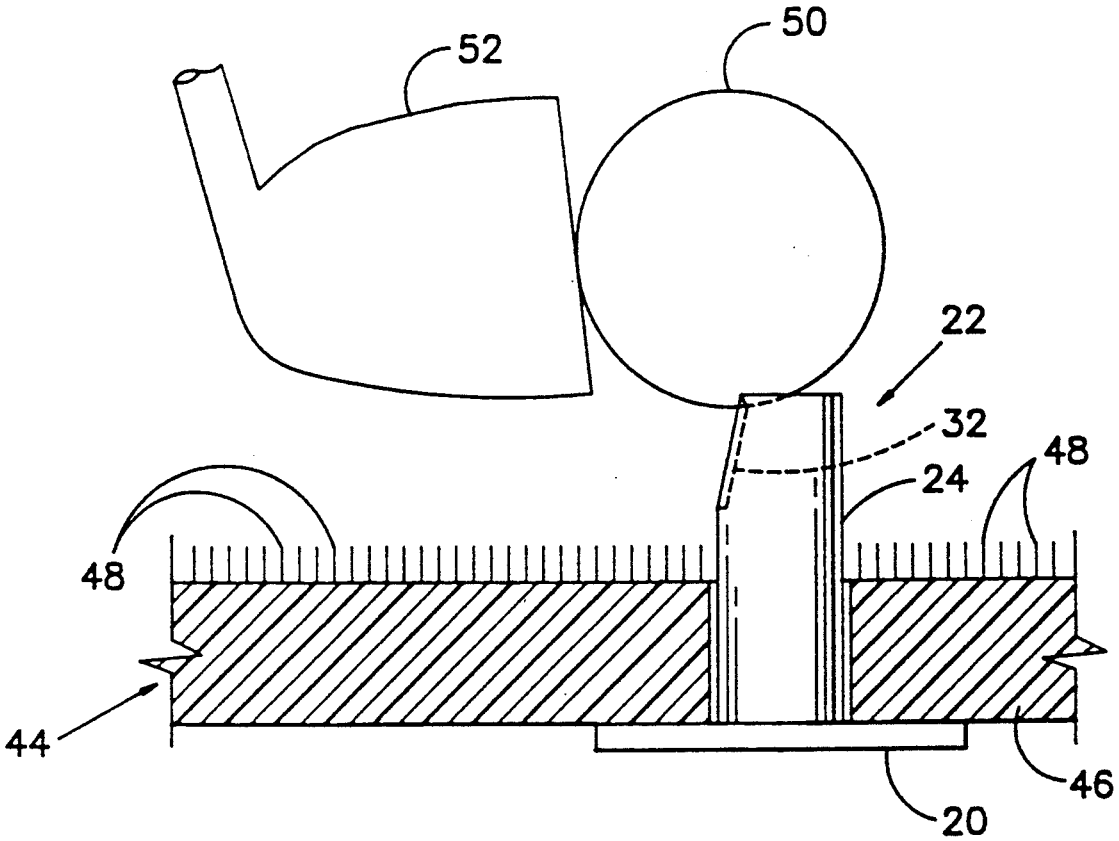

It is important to note that when the ball 50 reaches the top end of stem 24 forming the seat portion 26, the momentum of the moving ball tends to momentarily position the centerline of the ball slightly forward or to the right of the centerline of seat 26 as viewed in FIG. 10, which facilitates resilient strip 32 springing back to its original vertical position. This return of strip 32 to its original vertical position is important to maintain the ball 50 in a stable teed position. The upper end 34 of strip 32, when disposed in a vertical position, functions to cooperate as a part of the seat 26 to partially close the rearward periphery of the seat 26 and prevent the ball 50 from falling backward off the seat 26, or to the left as seen in FIG. 10, after it has been moved to a position on top of seat 26.

It may be preferred to dimension strip 32 such that the top end 34, in its vertical position, is slightly shorter than the remainder of the rim or beveled edge of seat 26 to ensure strip 34 to more readily spring back to its original position after ball 50 has been moved on top of seat portion 26. This modification is particularly helpful to reduce any frictional drag between top end 34 and the bottom of the ball 50 during return of strip 32 to its vertical position. Any such reduction in the height of strip 32 should not be so great as to nullify its function as a stop or part of the seat portion 26 upon return to its original vertical position to stabilize ball 50 in its teed position.

The extended nature of the modified seat portions 40-*a* and 40-*b* shown in FIGS. 2 and 5 and 3 and 6 also tend to permit strip 32-*b* or 32-*c* to more readily return to its original vertical position as the momentum of ball 50 as it is moved up the ramp to the top of the seat tends to initially carry the ball slightly beyond the central axis of stem 24-*a* or 24-*b*. This slight forward displacement of the ball during the mounting process also tends to raise the rearward portion of the ball slightly higher relative to the top end of strip 32. This action tends to provide additional clearance between the bottom of ball 50 and the top end 34-*a* or 34-*b* of strip 32-*a* or 32-*b* to aid in permitting the flexible strip to more readily return to its original position without significant drag or interference with the bottom of ball 50. Additionally, the modified seat portions described tend to prevent the ball from going to far forward and falling off the opposite edge of stem 24-*a* or 24-*b* relative to the flexible strip portion 32-*a* and 32-*b*.

While one preferred mode of mounting ball 50 onto tee 22 is to use the head of the golf club with which the user intends to strike the teed golf ball, one may also use the side of the toe portion of their shoe to accomplish the same purpose if desired. In either case, the user is not required to repeatedly bend over to mount the ball using their hand in the conventional manner.

While a relatively short learning period and generally average dexterity is required to tee the ball with relative ease as described, tests have indicated that experienced golfers, as well as non-golfers, have acquired the knack of teeing the ball in the manner described relatively quickly. However, it should be pointed out that the tee of the present invention can also be used in the conventional manner so that a user is not forced to tee the ball using the ramp feature as described herein. Using the practice tee of the present invention provides the user with the option of conventionally bending over to tee the ball by hand or using the clubhead or foot as described. Therefore the owner of a driving range may install the tee of the present invention and permit the user to choose either method of teeing the ball as they may desire.

Clearly, the improved tee of the present invention is a significant advantage for older persons or those who may have difficulty repeatedly bending over to tee the ball so as to enhance the use of such practice facilities with less physical effort and discomfort and yet enjoy the merits of striking many practice shots. Additionally, all golfers have an opportunity to reduce the physical effort required to tee the ball in a conventional manner using the golf practice tee as described herein.

It should also be noted that other modifications in the configuration or number of resilient strips such as 32 and seat configurations at the top of stem 24 are possible to create an inclined ramp surface which allows one to push and/or roll the golf ball onto the seat portion of the stem in an equivalent manner as described herein without departing from the spirit of the present invention.

What is claimed is:

1. A practice golf tee adapted for use with a conventional practice golf mat comprising;

a) a generally horizontal extending base provided with a generally planar bottom surface and an integrally formed generally cylindrical hollow stem portion extending vertically upward from said base and terminating in a top end forming a seat conformed to support a conventional golf ball in a teed position;

b) said hollow cylindrical stem including upstanding side walls provided with a pair of slots spaced from one another and extending axially downward from said top end toward said base and defining a resilient strip in said side walls between said slots resiliently movable between a normally, generally vertical position for aiding the support of a golf ball on said seat and an inwardly deflected position cooperating with opposing edges of said slots to define an inclined ramp for moving a golf ball up said ramp toward said seat.

2. The practice golf tee defined in claim 1 wherein said resilient strip is configured narrower at its top end than at its lower end.

3. The practice golf tee defined in claim 1 wherein said top end forming said seat includes a peripheral edge, a portion of said edge opposite said resilient strip being extended outwardly from the radial plane of the remainder of said peripheral edge.

4. The practice golf tee defined in claim 1 wherein the top end of said resilient strip is lower than the height of the top edge of said side walls of said stem forming said seat.

5. An improved practice golf tee of the type comprising a resilient material having an integrally formed horizontal extending base having a generally planar bottom surface for support and a vertically extending hollow stem portion provided with an top end forming a seat conformed to receive a conventional golf ball in a teed position, the improvement comprising;

a) a side wall forming part of said hollow stem including a pair of axially downwardly extending spaced edge surfaces converging toward one another to define a resilient strip between said edge surfaces in said side wall terminating at said top end of said stem portion, said strip being resiliently movable between a normally, generally vertical position and an inwardly deflected position;

b) said downwardly extending edge surfaces and said resiliently movable strip cooperating to form an inclined ramp upon engagement with a conventional golf ball to aid in moving a golf ball engaging said strip up said inclined ramp to a teed position on said seat of said stem portion.

6. The golf practice tee defined in claim 5 wherein said axially extending edges are formed by a pair of spaced slots disposed in said side wall of said stem portion.

7. The golf practice tee defined in claim 5 wherein said resilient strip has a configuration narrower at its top end relative to its lower end.

8. The golf practice tee defined in claim 5 wherein said seat includes a peripheral edge, a portion of said edge opposite from said resilient strip being formed at a height greater than adjacent peripheral edge portions.

* * * * *